US005702795A

United States Patent [19]

Matsumoto et al.

[11] Patent Number: 5,702,795

[45] Date of Patent: Dec. 30, 1997

[54] SPIRALLY WOVEN FABRIC, AND PREPREG AND ROTARY BODY EACH USING SAID SPIRALLY WOVEN FABRIC THEREIN

[75] Inventors: Takayuki Matsumoto; Tetsufumi Ikeda; Akiyoshi Kojima, all of Yokohama, Japan

[73] Assignee: Nippon Oil Co., Ltd., Tokyo, Japan

[21] Appl. No.: 798,120

[22] Filed: Feb. 12, 1997

[30] Foreign Application Priority Data

Feb. 21, 1996 [JP] Japan ..... 8-057010

[51] Int. Cl.[6] ..... D03D 3/00

[52] U.S. Cl. ..... 428/66.6; 74/572; 428/37; 428/222; 442/203

[58] Field of Search ..... 428/37, 222, 66.6; 442/203; 74/572

[56] References Cited

U.S. PATENT DOCUMENTS 4,507,983 4/1985 Kiss ..... 428/66.6

4,968,546 11/1990 Takahashi ..... 428/222

5,364,692 11/1994 Bowen et al. ..... 428/222

5,618,603 4/1997 De Rees ..... 428/37

*Primary Examiner*—James J. Bell

*Attorney, Agent, or Firm*—Kubovcik & Kubovcik

[57] ABSTRACT

A spirally woven fabric as well as a prepreg and a rotary body each using the fabric therein is adapted for use as materials for high-speed rotary bodies such as flywheels for electric power storage. The fabric composed of interwoven warps and wefts is such that its warps are arranged in a spiral direction, and the warps positioned more outside in the radial (weft) direction have a higher specific elastic modulus in the warp direction than those positioned more inside in the radial direction whereby a rotary body made of the fabric is enabled to be rotated at a higher rotating speed without breakage of the wefts and consequent peeling-off between the warps.

9 Claims, 1 Drawing Sheet

SPIRALLY WOVEN FABRIC, AND PREPREG AND ROTARY BODY EACH USING SAID SPIRALLY WOVEN FABRIC THEREIN

BACKGROUND OFT HE INVENTION

1. Field of the Invention

This invention relates to a spirally woven fabric which can be suitably used as a material for high-speed rotary bodies such as a flywheel for storing electric power, and also to a prepreg and a rotary body each using the spirally woven fabric therein.

2. Prior Art

Fiber-reinforced plastics (FRP) provided with high specific strength has been used in the past as a material for use in high-speed rotary bodies such as a flywheel for storing electric power. Coiled rims molded by a sheet winding method, a filament winding method or the like each using a coiled sheet 4 made of fibers as a reinforcing material as shown in FIG. 3 have been mainly used at the early stage of such a high strength material as above, and, however, they are not satisfactory because they are a kind of a unidirectional fiber-reinforced material, and therefore, have extremely low strength in the radial direction (direction perpendicular to the fibers) as compared with that in the peripheral direction (fibers- arranged direction). Therefore, the coiled rims are apt to cause peeling-off between the coiled fiber sheets, and hence, the coiled rims will be low in allowable maximum rotation velocity.

It has thus been proposed to use rims composed of, as a reinforcing material, a spirally woven fabric 1 as shown in FIG. 1 in place of such a coiled rim. The spirally woven fabrics disclosed in Japanese Pat. Appln. Laid-Open Gazettes Nos. Sho 56-73138 (73138/81) and Hei 5-321071 (321071/93) as well as in Japanese National Phase Laid-Open (Kohyo) Gazette No. Hei 3-504401 (504401/91) (PCT International Publication No. WO90/10103) are those obtained by interweaving warps arranged in a spiral direction with wefts arranged in the radial direction. The inventions of these Gazettes contemplate to give uniform strength to every part of the woven fabric by using a single kind of warps and keeping the weight per unit area (for example, $gr/m^2$) at every part of the woven fabric uniform.

However, in a case where such a spirally woven fabric is utilized for forming a high speed rotary body and the rotary body is rotated, a centrifugal force will more greatly act on-the warps positioned at the outside in the radial direction of the rotary body than on those positioned at the inside in the same direction as above, whereupon a strain occurring in the warps at the outside is greater than that in the warps at the inside. In consequence, a great stress is applied to the wefts in the direction thereof (that is, in the radial direction of the rotary body), the wefts are broken, and peeling-off between the warps is apt to start at the broken portion. Accordingly, this spirally woven fabric cannot reliably be applied to the high-speed rotary body.

In view of the problems with the prior art described above, it is therefore a main object of this invention to provide a spirally woven fabric capable of withstanding a higher rotating velocity, and also provide a prepreg as well as a rotary body each using such a spiral woven fabric therein.

SUMMARY OF THE INVENTION

To accomplish the object described above, a spirally woven fabric according to this invention is such that its warps are arranged in a spiral direction, and the warps arranged or positioned more outside in the radial direction have a higher specific elastic modulus in the warp direction than those arranged or positioned more inside in the radial direction. Generally, the specific elastic modulus is increasingly changed every a plurality of warps as the plurality of warps are arranged more outside in the radial direction.

A prepreg according to this invention is characterized by the use of this spirally woven fabric as a reinforcing material. Further, a rotary body according to this invention is characterized by laminating the prepregs together in the direction of the spiral axis and then curing the laminated prepregs to shape them into the rotary body.

Incidentally, the term "specific elastic modulus" herein used means the value obtained by dividing the tensile elastic modulus of a single fiber in the fiber direction (which modulus is measured in accordance with JIS R 7601(1986)) by the density of the fiber. The term "fiber density" means the density of the fiber itself exclusive of a matrix such as a resin.

The above and other objects and features of this invention will become more apparent from the following detailed description when taken in conjunction with the accompanying drawings.

BRIEF DESCRIPTION OF THE DRAWINGS

In FIGS. 1 and 2, reference numeral 1 denotes a spirally woven fabric, reference numeral 2 denotes a warp disposed in the spiral direction and reference numeral 3 denotes a weft disposed in the radial direction. Incidentally, the spirally woven fabric according to this invention is not particularly limited to the woven structure as shown in FIG. 2, but it may be an arbitrary woven structure such as a plain weave, a twill weave or a satin weave.

Figure 1:
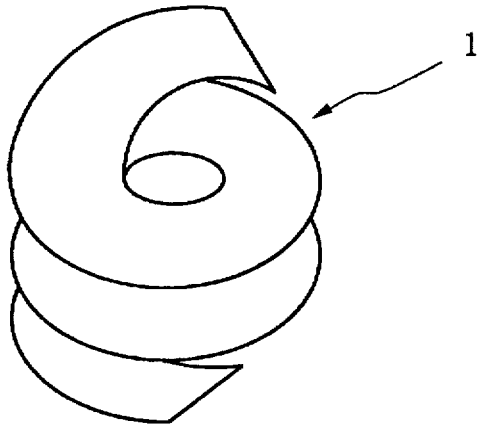
FIG. 1 is a schematic perspective view showing, in the state of being somewhat elongated in the direction of the spiral axis, a spirally woven fabric according to an embodiment of this invention.
Figure 2:
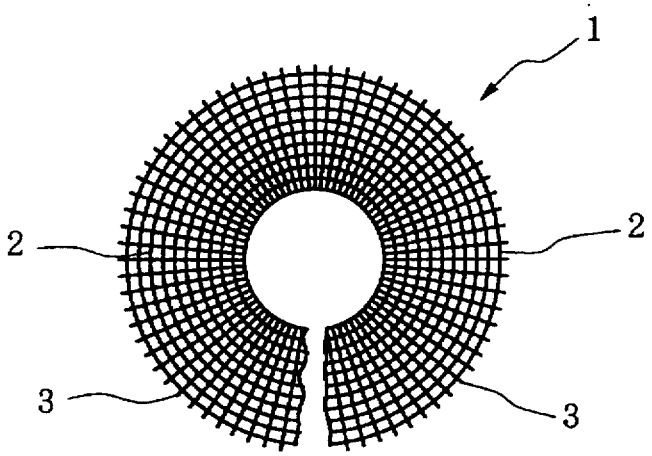
FIG. 2 is a plan view showing one round of the spirally woven fabric shown in FIG. 1.
Figure 3:
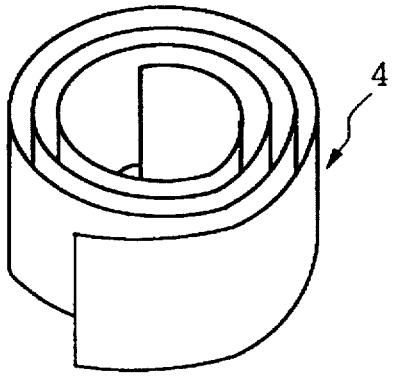
FIG. 3 is a schematic perspective view showing a conventional fiber sheet in the coiled state.

The warp 2 reinforces the strength of the spirally woven fabric in the spiral direction, and may be a glass fiber, an aramid fiber, a boron fiber, a carbon fiber or their combined filament yarn. The number of filaments of each warp 2 depends on the kind of the filaments used, but it is generally 100 to 120,000 and preferably 1,000 to 30,000.

The specific elastic modulus of the warp 2 increases either continuously or stepwise from the inside towards the outside in the radial direction of the spirally woven fabric. In other words, the warps are divided into at least two groups, preferably 2 to 10 groups, respectively having different specific elastic moduli, and the specific elastic modulus of the warps in each warp group is kept constant. In this instance, if all the groups consist of a single warp, the specific elastic modulus becomes continuously higher, and if each group consists of at least two warps, the specific elastic modulus becomes stepwise higher. If warp groups each consisting of a single warp and warp groups each consisting of at least two warps are both disposed in a woven fabric to be obtained, the woven fabric so obtained will have both portions at which the specific elastic modulus becomes continuously higher and portions at which the specific elastic modulus becomes stepwise higher. Though any of these arrangements can be employed in the present invention, it is preferred from the aspect of production to stepwise increase the specific elastic modulus.

When the specific elastic modulus of the warps is stepwise changed, the distribution of each warp group and its specific elastic modulus can be determined by the following formula:

$$(E1/\rho 1)\times(r/r1)^2 \leqq E/\rho \leqq (E1/\rho 1)\times(r/r1)^4$$

Preferably $$(E/\rho 1)\times(r/r1)^{2.5} \leqq E/\rho \leqq (E1/\rho 1)\times(r/r1)^{3.8}$$

wherein

- r1: distance between central warp of innermost warp group and spiral center in radial direction of spiral woven fabric,
- E1: tensile elastic modulus of warp belonging to this innermost warp group,
- ρ1: fiber density of warps belonging to this innermost warp group,
- r: distance between central warp of each warp group positioned outside the innermost warp group and spiral center in radial direction of spiral woven fabric,
- E: tensile elastic modulus of warp belonging to this outside warp group,
- ρ: fiber density of warp belonging to this outside warp group.

In a case where the warps are divided into, for example, four groups, the specific modulus of the warps belonging to the innermost warp group can be set to $2\times10^6$ to $5\times10^6$ m, the specific elastic modulus of the warps belonging to the second innermost warp group can be set to more than $5\times10^6$ to $17.5\times10^6$ m, the specific elastic modulus of the warps belonging to the third innermost warp group can be set to more than $17.5\times10^6$ to $32.5\times10^6$ m, and the specific elastic modulus of the warps belonging to the outermost warp group can be set to more than $32.5\times10^6$ to $50\times10^6$ m.

In a case where the warps are divided into two groups, the specific elastic modulus of the warps of the innermost warp group can be set to $2\times10^6$ to $17.5\times10^6$ m, and the specific elastic modulus of the warps of the outermost warp group can be set to more than $17.5\times10^6$ to $50\times10^6$ m.

Incidentally, in the preparation of a fabric of this invention, the gaps between warps can be set in such a manner as to become increasingly smaller as warps are arranged or positioned more outside in the radial direction of the fabric. It is also possible to gradually increase the number of filaments per yarn of warps as warps are arranged or positioned more outside in the radial direction of the fabric.

The weft 3 reinforces the strength of the spiral woven fabric in the radial direction of a fabric to be obtained, and may be a fiber similar to the warp for such reinforcing. However, it is preferable that the fiber be one having high specific strength, particularly a pitch- or PAN-based carbon fiber. The PAN-based carbon fibers include those under the tradenames of T300 and T7005 produced by Toray Industries, Inc.

The length of the weft 3 may be fixed. Since the density (weight/unit area) of wefts gradually decreases toward the outside in the case of spirally woven fabric and, however, it is possible to add short wefts to the outside portion of the fabric so as to make up for the decrease of the density. The number of filaments of the wefts is preferably constant.

The volume ratios between the warps 2 and the wefts 3 are from 50–99 vol % to 1–50 vol %, preferably from 80–95 vol % to 5–20 vol %. The weight/unit area of the spirally woven fabric is 100 to 500 g/m$^2$ and preferably 200 to 400 g/m$^2$ and is preferably constant irrespective of the distance from the spiral center.

This invention is also directed to a prepreg and a rotary body each using the spirally woven fabric having the structure described above, and matrix resins for use in these articles of this invention are thermosetting resins with epoxy resins being preferred.

DESCRIPTION OF THE PREFERRED EMBODIMENTS

Example 1

Both PAN-based carbon fibers (produced under the tradename of T300 by Toray Industries, Inc.) as the wefts, and warps shown in Table 2 were interwoven in the preparation of spirally woven fabrics of this invention in the texture of which were disposed four warp groups respectively different specific moduli. Table 1 tabulates the physical property values of these fibers and the disposition of the four warp groups. The names of the fibers tabulated in Table 1 are the tradenames. Namely, Glass Fiber Yarn ECE is E-glass produced by Nitto Boseki Co., Ltd., and XN50 and XN80 are pitch-based carbon fibers produced by Nippon Oil Co., Ltd. The dispositions of the four warp groups are respectively determined with R representing the outer diameter of the spirally woven fabric and r representing the distance between an arbitrary warp and the spiral center of the spiral woven fabric.

The weight/unit area of the fabrics was made 300 g/m$^2$, the gap between the adjacent warps was made to be smaller as they were arranged more outside in the radial direction of the fabric, the number of filaments of the warps was made constant, and the inner diameter of the spirally woven fabrics was made 60 mm and the outer diameter thereof 200 mm.

The spirally woven fabrics were immersed in or impregnated with an epoxy resin to form spiral prepregs, and the prepregs were laminated to obtain a 40 mm-thick laminate. The laminate was then heat cured to produce a rotary body. Alternatively, the spiral prepreg having three rounds as shown in FIG. 1 may be compressed in the direction of central axis of the spiral prepreg to obtain a compressed body or a three-layered pseudo-laminate (such a pseudo-laminate being hereinafter simply called "laminate") which is then heat cured to produce a rotary body.

Then, the thus produced rotary bodies were measured for their possible maximum rotating velocity (such rotating velocity as to cause the tensile break of the wefts and peeling between the warps). The result was tabulated in Table 2 with the kinds of the warps and wefts used, the energy and energy density at the maximum rotating velocity, and the weight of the rotary body.

Example 2

Rotary bodies were each produced in the same way as in Example 1 with the exception that two warp groups consisting respectively of glass fiber yarns ECE and XN50 were disposed at such positions as to satisfy the relations, $0.3 \leqq r/R < 0.5$ and $0.5 \leqq r/R \leqq 1.0$, respectively, and then they were each measured for the maximum rotating velocity. The result was tabulated in Table 2.

Comparative Example 1

The procedure of Example 1 was followed except that one kind of warps, that is, T300, was used as the warps, to produce rotary bodies which were then each measured for the maximum rotating velocity. The result was tabulated in Table 2.

Comparative Example 2

The procedures of Example 1 was followed except that wefts were not used, to produce composite material rotary bodies which were then each measured for the maximum rotating velocity. The result was tabulated in Table 2.

Comparative Example 3

Rotary bodies were each produced in the same way as in Example 2 with the exception that the wefts were not used, and the maximum rotating velocity thereof was measured. The result was tabulated in Table 2.

Comparative Example 4

Rotary bodies were each produced in the same way as in Comparative Example 1 with the exception that the wefts were not used, and the maximum rotating velocity thereof was measured. The result was tabulated in Table 2.

Comparative Example 5

There were produced steel-made rotary bodies each having an inner diameter of 60 mm, an outer diameter of 200 mm and a thickness of 40 mm.

TABLE 1

| Fiber | Tensile strength MPa | Tensile elastic modulus GPa | Fiber diameter μm | Fiber density g/cm³ | Arrangements of 4 warp groups in Ex. 1 |
|---|---|---|---|---|---|
| Glass Fiber Yarn ECE | 3430 | 73 | 10 | 2.55 | $0.3 \leqq r/R < 0.5$ |
| T300 | 3530 | 230 | 7 | 1.76 | $0.5 \leqq r/R < 0.7$ |
| XN50 | 3730 | 490 | 9.5 | 2.14 | $0.7 \leqq r/R < 0.9$ |
| XN80 | 3530 | 780 | 9.5 | 2.17 | $0.9 \leqq r/R \leqq 1.0$ |

TABLE 2

| | Kinds of reinforcing fibers | | Maximum rotating velocity | Energy | Energy density | Weight |
|---|---|---|---|---|---|---|
| | Warp | Weft | rpm | Wh | Wh/kg | kg |
| Ex. 1 | ECE + T300 + XN50 + XN80 | T300 | 125,000 | 328 | 164 | 2.0 |
| Ex. 2 | ECE + XN50 | T300 | 105,000 | 220 | 106 | 2.1 |
| Comp. Ex. 1 | T300 | T300 | 86,000 | 141 | 78 | 1.8 |
| Comp. Ex. 2 | ECE + T300 + XN50 + XN80 | none | 82,000 | 140 | 70 | 2.0 |
| Comp. Ex. 3 | ECE + XN50 | none | 71,000 | 101 | 49 | 2.1 |
| Comp. Ex. 4 | T300 | none | 60,000 | 69 | 38 | 1.8 |
| Comp. Ex. 5 | steel | | 23,000 | 47 | 5 | 8.9 |

* ECE denotes Glass Fiber Yarn ECE.

Effects of the Invention

Since the spirally woven fabric according to this invention uses the warps having higher elastic moduli as they are arranged more outside in the radial direction of the spirally woven fabric, the strains caused on the inside and the outside will become approximate to each other when this woven fabric is used as a material for a high speed rotary body. Therefore, breakage of the wefts and peeling between the warps accompanied with this breakage become difficult to occur, thereby enabling rotary bodies having a greater allowable rotating velocity to be produced. For this reason, the spirally woven fabric of this invention, and the prepreg and rotary body each using the spirally woven fabric therein, are excellent as materials for high-speed rotary bodies such as rotors for centrifuges and flywheels for electric power storage.

What is claimed is:

1. A spirally woven fabric composed of interwoven warps and wefts and having the warps arranged in a spiral direction and the wefts arranged in the radial direction, characterized in that the warps arranged more outside in the radial direction of said fabric have an increasingly greater specific elastic modulus than those arranged more inside in the radial direction of said fabric.

2. A spirally woven fabric according to claim 1, wherein the specific elastic modulus is increasingly changed every a plurality of warps as the plurality of warps are arranged more outside in the radial direction.

3. A prepreg in the spiral form prepared by impregnating the spirally woven fabric of claim 1 with a thermosetting resin.

4. A rotary body prepared by compressing a spiral prepreg of claim 3 in the direction of central axis of the spiral prepreg to form a compressed prepreg in the form of a laminate and then heat curing the thus produced laminate thereby to obtain a rotary body.

5. A spirally woven fabric according to claim 2, wherein there are arranged at least two warp groups each consisting of warps having the same specific elastic modulus as each other, and the warps of one warp group arranged more outside in the radial direction of said fabric have a greater specific elastic modulus than those of the other warp groups arranged more inside in the radial direction of said fabric.

6. A spirally woven fabric according to claim 5, wherein the number of the warp groups is from 2 to 10.

7. A spirally woven fabric according to claim 5, wherein the warp groups and the specific elastic moduli of the warps of said warp groups have the following relation:

$$(E1/\rho 1)\times(r/r1)^2 \leqq E/\rho \leqq (E1/\rho 1)\times(r/r1)^4$$

wherein r1 is the distance between the central warp of the innermost warp group and the spiral center each in the radial direction of the spiral woven fabric;

E1 is the tensile elastic modulus of the warp of the innermost warp group;

ρ1 is the fiber density of the warp of the innermost warp group;

r is the distance between the central warp of any warp group positioned outside the innermost warp group and the spiral center each in the radial direction of the spiral woven fabric;

E is the tensile elastic modulus of the warp of the outside warp group; and

ρ is the fiber density of the warp of the outside warp group, E/ρ and E1/ρ1 being specific elastic modulus.

8. A spirally woven fabric according to claim 5, wherein the number of the warp groups is 2 and the warps of the innermost warp group have a specific elastic modulus of $2\times10^6$ to $17.5\times10^6$ m and the warps of the outermost warp group have a specific elastic modulus of more than $17.5\times10^6$ to $50\times10^6$ m, the innermost and outermost being with respect to the radial direction of the spiral woven fabric.

9. A spirally woven fabric according to claim 5, wherein the number of the warp groups is 4; and the warps of the innermost warp group have a specific elastic modulus of $2\times10^6$ to $5\times10^6$ m;

those of the second innermost warp group have that of more than $5\times10^6$ to $17.5\times10^6$ m;

those of the third innermost warp group have that of more than $17.5\times10^6$ to $32.5\times10^6$ m and those of the outermost warp group have that of more than $32.5\times10^6$ to $50\times10^6$ m, the innermost and outermost being with respect to the radial direction of the spiral woven fabric.

* * * * *